US007992861B2

(12) United States Patent
Furuya et al.

(10) Patent No.: US 7,992,861 B2
(45) Date of Patent: Aug. 9, 2011

(54) RECORDING MEDIUM SUPPLY APPARATUS AND IMAGE FORMING APPARATUS HAVING BUCKLING PREVENTION UNIT

(75) Inventors: Takao Furuya, Ebina (JP); Kaoru Yoshida, Kanagawa (JP); Yoshinari Iwaki, Ebina (JP); Shin Takeuchi, Minato-ku (JP); Minoru Ohshima, Ebina (JP); Dmitry Ivutin, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 36 days.

(21) Appl. No.: 11/907,066

(22) Filed: Oct. 9, 2007

(65) Prior Publication Data

US 2008/0197563 A1 Aug. 21, 2008

(30) Foreign Application Priority Data

Feb. 15, 2007 (JP) ..... 2007-034448

(51) Int. Cl.
*B65H 3/52* (2006.01)

(52) U.S. Cl. ..... 271/125; 271/10.02; 271/188

(58) Field of Classification Search ..... 271/10.02, 271/115, 122, 124, 125, 188
See application file for complete search history.

(56) References Cited

U.S. PATENT DOCUMENTS

| | | | | |
|---|---|---|---|---|
| 4,544,147 | A * | 10/1985 | Dinnissen | 271/35 |
| 5,153,663 | A * | 10/1992 | Bober et al. | 271/188 |
| 6,913,257 | B2 * | 7/2005 | Takaki et al. | 271/125 |
| 2005/0206069 | A1 * | 9/2005 | Yamamoto | 271/117 |

FOREIGN PATENT DOCUMENTS

| | | | |
|---|---|---|---|
| JP | 56-048343 | A | 5/1981 |
| JP | 04-197931 | A | 7/1992 |
| JP | 05-186082 | A | 7/1993 |
| JP | 08-25657 | | 1/1996 |
| JP | 8-25657 | | 3/1996 |
| JP | 08-225173 | A | 9/1996 |
| JP | 10-291659 | A | 11/1998 |
| JP | 11-059975 | A | 3/1999 |

* cited by examiner

*Primary Examiner* — Gerald W McClain
(74) *Attorney, Agent, or Firm* — Morgan, Lewis & Bockius LLP

(57) ABSTRACT

A recording medium supply apparatus includes: a conveyance member that conveys a recording medium; a retard member, in contact with the conveyance member, that forms a contact portion between the conveyance member and the retard member and retards the recording medium by holding the recording medium in the contact portion; and a buckling prevention unit, configured to contact with the recording medium on the upstream side of the contact portion between the conveyance member and the retard member in a conveyance direction of the recording medium, that prevents buckling of the recording medium in the conveyance direction.

11 Claims, 11 Drawing Sheets

(a)

(b)

(a)

(b)

OPERATION OF SHEET FEEDING DEVICE 10

OPERATION OF SHEET FEEDING DEVICE S20

OPERATION OF SHEET FEEDING DEVICE S30

RECORDING MEDIUM SUPPLY APPARATUS AND IMAGE FORMING APPARATUS HAVING BUCKLING PREVENTION UNIT

CROSS-REFERENCE TO RELATED APPLICATIONS

This application is based on and claims priority under 35 USC 119 from Japanese Patent Application No. 2007-034448 filed Feb. 15, 2007.

BACKGROUND

1. Technical Field

The present invention relates to a recording medium supply apparatus and an image forming apparatus having the recording medium supply apparatus.

2. Related Art

SUMMARY

According to an aspect of the invention, there is provided a recording medium supply apparatus including: a conveyance member that conveys a recording medium; a retard member, in contact with the conveyance member, that forms a contact portion between the conveyance member and the retard member and retards the recording medium by holding the recording medium in the contact portion; and a buckling prevention unit, configured to contact with the recording medium on the upstream side of the contact portion between the conveyance member and the retard member in a conveyance direction of the recording medium, that prevents buckling of the recording medium in the conveyance direction.

BRIEF DESCRIPTION OF THE DRAWINGS

Exemplary embodiments of the present invention will be described in detail based on the following figures, wherein.

DETAILED DESCRIPTION

Next, exemplary embodiments of the present invention will be described based on the drawings.

Figure 1:
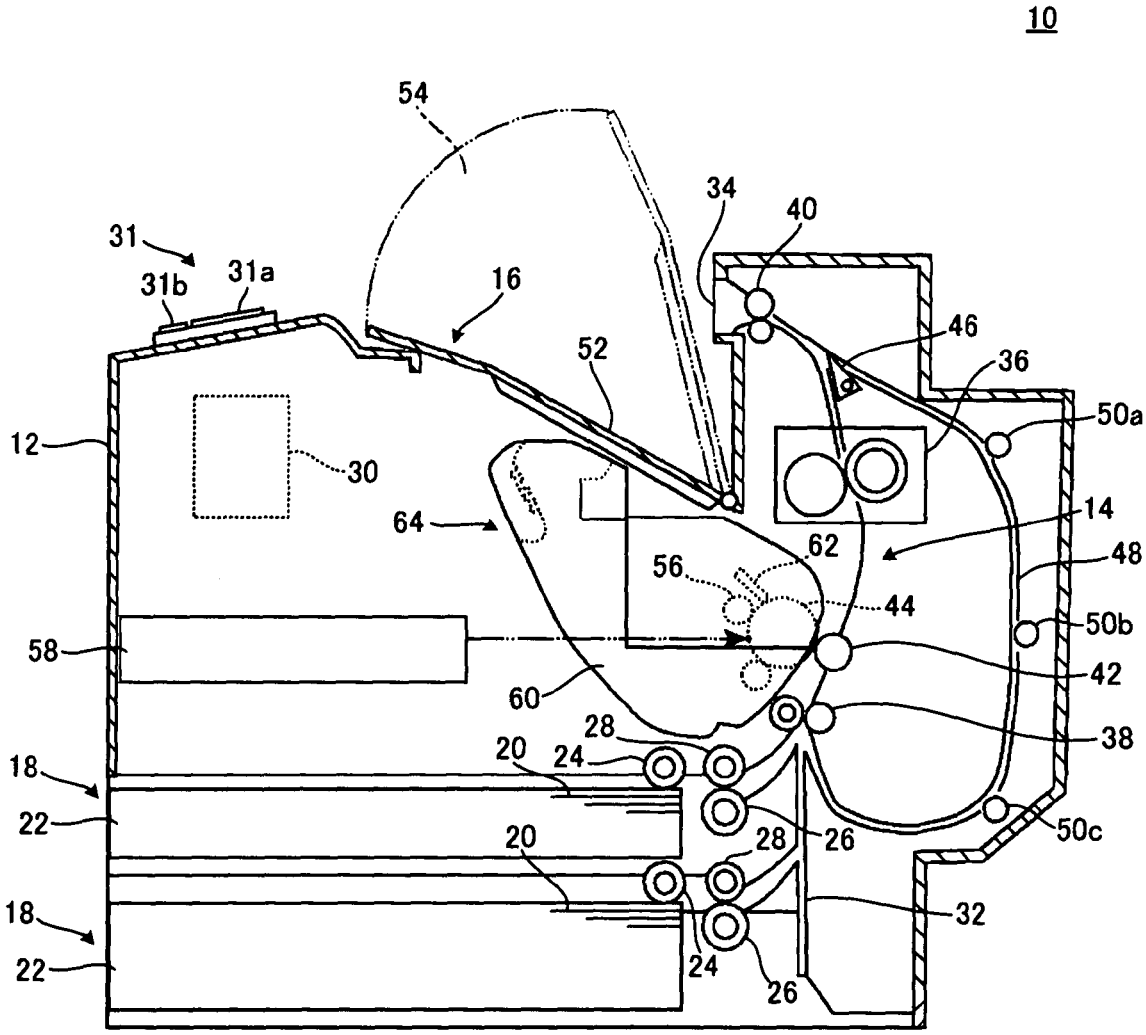
FIG. 1 is a cross-sectional view showing an image forming apparatus according to a first exemplary embodiment of the present invention.

FIG. 1 schematically shows the structure of an image forming apparatus 10 according to the exemplary embodiments of the present invention. The image forming apparatus 10 has an image forming apparatus main body 12. An image forming unit 14 is provided in the image forming apparatus main body 12. A discharge part 16 to be described later is provided in an upper part of the image forming apparatus main body 12, and sheet feeding devices 18, as an example of two-stage recording medium supply apparatus, are provided in a lower part of the image forming apparatus main body 12.

The sheet feeding devices 18 respectively have a sheet feeding cassette 22 in which sheets 20, as an example of recording media, are stacked. A pickup roller 24 is provided in an upper position around a rear end of the sheet feeding cassette 22, and a retard roller 26 as an example of a retard member and a feed roller 28 as an example of a conveyance member are provided on the upstream side of the pickup roller 24 in a sheet conveyance direction. The pickup roller 24, the retard roller 26 and the feed roller 28 may be provided in the image forming apparatus main body 12 or may be provided in the sheet feeding cassette 22.

A main conveyance path 32 is a sheet passage from the feed roller 28 to a discharge port 34. The main conveyance path 32 has a portion placed around a rear side (right side of FIG. 1) of the image forming apparatus main body 12 and approximately vertically formed from the sheet feeding device 18 on the bottom end to a fixing device 36 to be described later. A transfer device 42 and an image holder 44 to be described later are provided on the upstream side of the fixing device 36 on the main conveyance path 32 in the sheet conveyance direction, and further, a registration roller 38 is provided on the upstream side of the transfer device 42 and the image holder 44 in the sheet conveyance direction. Further, a discharge roller 40 is provided around the discharge port 34 of the main conveyance path 32.

Accordingly, the sheets 20 fed with the pickup roller 24 from the sheet feeding cassette 22 of the sheet feeding device 18 are retarded with the retard roller 26 and the feed roller 28 in cooperation with each other, and only the top sheet is guided to the main conveyance path 32. The sheet is temporarily stopped with the registration roller 38, then passed between the transfer device 42 and the image holder 44 to be described later at predetermined timing, while a developing material image is transferred to the sheet. Then the transferred developing material image is fixed to the sheet with the fixing device 36, and the sheet is discharged with the discharge roller 40 from the discharge port 34 to the discharge part 16.

Note that in the case of double sided printing, the sheet is returned to a reverse path. That is, in the main conveyance path 32, a portion in front of the discharge roller 40 is branched into two parts. A switching device 46 is provided on the branch portion, and a reverse path 48 which returns from the branched part to the registration roller 38 is formed. The reverse path 48 is provided with conveyance rollers 50*a* to 50*c*. In the case of double sided printing, the switching device 46 is switched to a side to open the reverse path 48. When a part of the sheet around its rear end arrives at the discharge roller 40, the discharge roller 40 is reversed, then the sheet is guided to the reverse path 48, then passed through the registration roller 38, the transfer device 42, the image holder 44 and the fixing device 36, and discharged from the discharge port 34 to the discharge part 16.

The discharge part 16 has a slope member 52 rotatable with respect to the image forming apparatus main body 12. In the slope member 52, a part at the discharge port is low, then the slope gradually becomes steep toward a frontforward direction (leftward direction in FIG. 1). The part at the discharge port is a lower end and the high end is an upper end of the slope member 52. The slope member 52 is supported with the image forming apparatus main body 12 such that the slope member 52 is rotatable about the lower end. As indicated with an alternate long and two dash line in FIG. 1, when the slope member 52 is rotated upward thereby is opened, an open portion 54 is formed. A process cartridge 64 to be described later can be attached/removed via the open portion 54.

The image forming unit 14, which is e.g. an electrophotographic unit, has the image holder 44 having a photoreceptor, a charging device 56 having e.g. a charging roller to charge the image holder 44, an optical writing device 58 to optically write a latent image on the image holder 44 charged with the charging device 56, a developing device 60 to visualize the latent image on the image holder 44, formed with the optical writing device 58, with developing material, the transfer device 42 having e.g. a transfer roller to transfer the developing material image developed with the developing device 60 to the sheet 20, a cleaning device 62 having e.g. a blade to remove developing material remaining on the image holder 44, and the fixing device 36 to fix the developing material image on the sheet 20, transferred with the transfer device 42, to the sheet 20.

The image holder 44, the charging device 56, the developing device 60 and the cleaning device 62 are integrated as the process cartridge 64. The process cartridge 64 is provided below and immediately near the slope member 52 of the discharge part 16. As described above, the process cartridge 64 is attached/removed via the open portion 54 formed by opening the slope member 52.

A controller 30 is provided in the image forming apparatus main body 12. The controller 30 is electrically connected to respective constituent elements such as the sheet feeding device 18, a motor 96 and a displacement sensor 98 to be described later, and controls operations of these respective constituent elements.

A user interface device 31 as an example of an input unit is provided integrally with the image forming apparatus main body 12 or via a network, and is electrically connected to the controller 30. The user interface device 31 is provided with a display panel 31*a*, input buttons 31*b* and the like, to select processing contents in the image forming apparatus 10 and display the selected contents.

Next, the details of the sheet feeding device 18 will be described based on FIGS. 2A and 2B.

Figure 2:
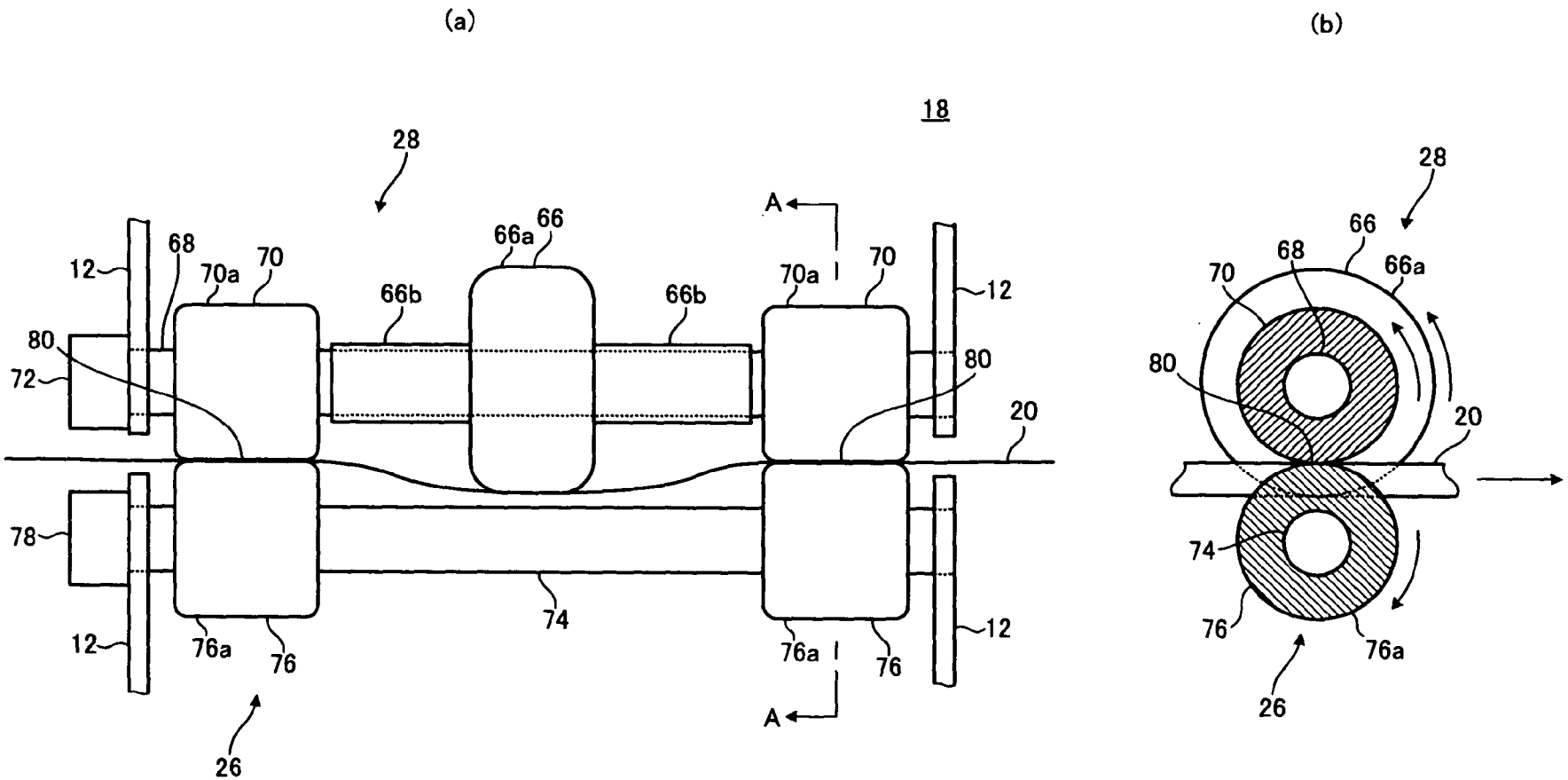
FIG. 2A is a front view showing a sheet feeding device according to the first exemplary embodiment of the present invention.
FIG. 2B is a cross-sectional view of the sheet feeding device according to the first exemplary embodiment of the present invention cut along a line A-A in FIG. 2A.

As shown in FIGS. 2A and 2B, the sheet feeding device 18 has the feed roller 28, the retard roller 26 and a deforming member 66 as an example of a buckling preventing unit.

The feed roller 28 has a first support shaft 68 rotatably supported with the image forming apparatus main body 12 and two first main bodies 70 supported with the first support shaft 68. The two first main bodies 70, having circumferential surfaces 70*a* with the center of the first support shaft 68 as their center, are provided away from each other by a predetermined interval. A gear 72 is provided on one end of the first support shaft 68, and the gear 72 is connected to a driving source (not shown).

The deforming member 66 is configured to contact with the recording medium on the upstream side of a contact portion 80 between the feed roller 28 and the retard roller 26 in a sheet conveyance direction. More particularly, the deforming member 66 is provided between the two first main bodies 70, and is rotatably provided on the first support shaft 68. The deforming member 66, formed in a cylindrical shape, has a circumferential surface 66*a* larger than the first main bodies 70. A boss 66*b* is provided at a rotational center of the deforming member 66. The boss 66*b* is formed in a cylindrical shape projected from both end surfaces of the deforming member 66. The boss 66*b*, having a predetermined length, regulates movement of the deforming member 66 in its axial direction.

The retard roller 26 has a second support shaft 74 rotatably supported with the image forming apparatus main body 12 and two second main bodies 76 supported with the second support shaft 74. The second main bodies 76 have circumferential surfaces 76*a* with the center of the second support shaft 74 as their center. The second main bodies 76 are provided in positions opposite to the first main bodies 70 of the feed roller 28. The contact portion 80 is formed between the first main bodies 70 of the feed roller 28 and the second main bodies 76 of the retard roller 26. The retard roller 26 is rotated with a rotational force from the feed roller 28.

A gear 78 is provided on one end of the second support shaft 74, and is connected to a torque limiter (not shown). Accordingly, when two or more sheets 20 are guided to the contact portion 80 between the first main bodies 70 of the feed roller 28 and the second main bodies 76 of the retard roller 26, since a friction force between the sheets is smaller in comparison with a torque set at the torque limiter, the second main bodies 76 of the retard roller 26 reverse-rotate, then the sheet (s) other than the sheet in contact with the first main bodies 70 of the feed roller 26 are returned to the opposite side to the sheet conveyance direction. In this manner, the retard roller 26, in contact with the feed roller 28, and forming the contact portion 80 between the feed roller 28 and the retard roller 26, retards the sheet 20 by holding the sheet 20 in this contact portion 80.

Note that it may be arranged such that when two or more sheets 20 are guided to the contact portion 80 between the first main bodies 70 of the feed roller 28 and the second main bodies 76 of the retard roller 26, rotation of the second main bodies 76 of the retard roller 26 is stopped.

The deforming member 66 comes into contact with the sheet 20 fed with the pickup roller 24 from the sheet feeding cassette 22, and rotates along with the conveyance of the sheet 20. By this arrangement, the deforming member 66 deforms the sheet 20 in a C-shape viewed from a direction other than a direction orthogonal to the sheet conveyance direction, e.g., the sheet conveyance direction, on the upstream side of the contact portion 80 between the feed roller 28 and the retard roller 26 in the sheet conveyance direction.

Note that the deforming member 66 may be provided on the second support shaft 74. Further, the retard roller 26 may be replaced with a non-rotating friction member or the like.

Figure 3:
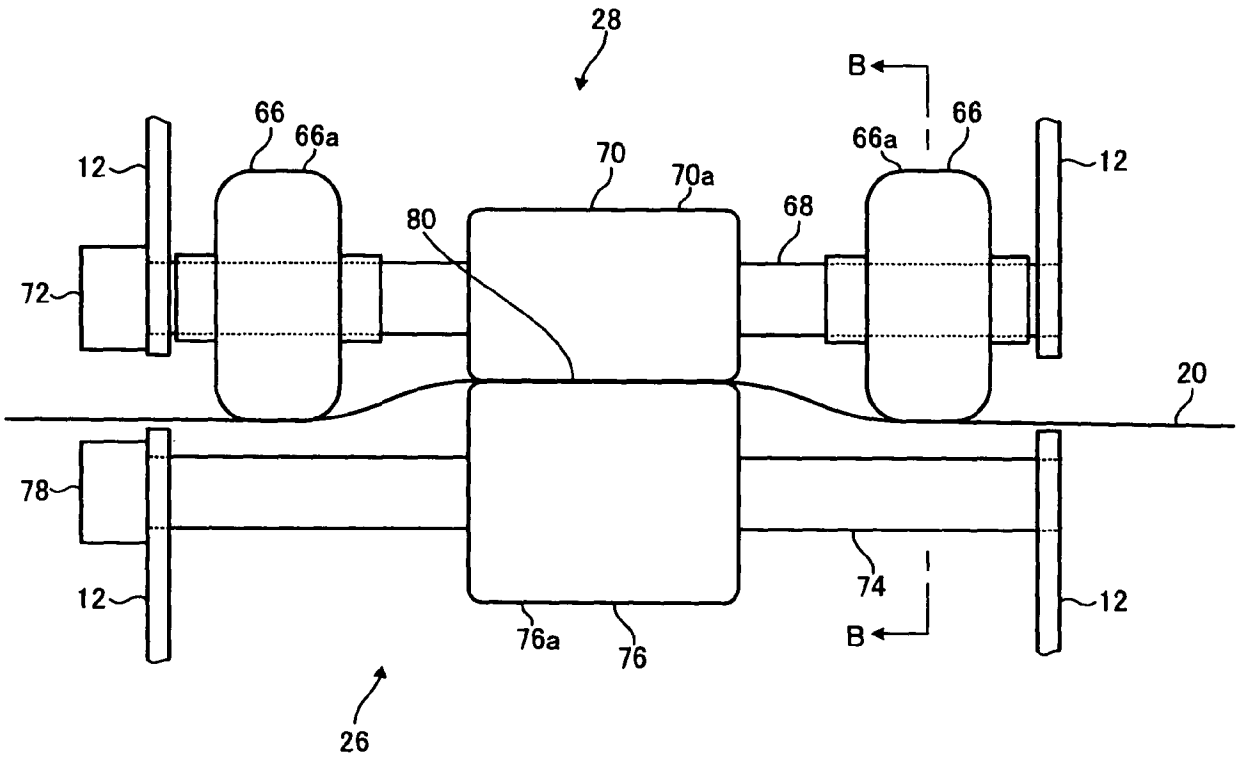
FIG. 3A is a front view showing the sheet feeding device according to a second exemplary embodiment of the present invention.
FIG. 3B is a cross-sectional view of the sheet feeding device according to the second exemplary embodiment of the present invention cut along a line B-B in FIG. 3A.
Figure 3:
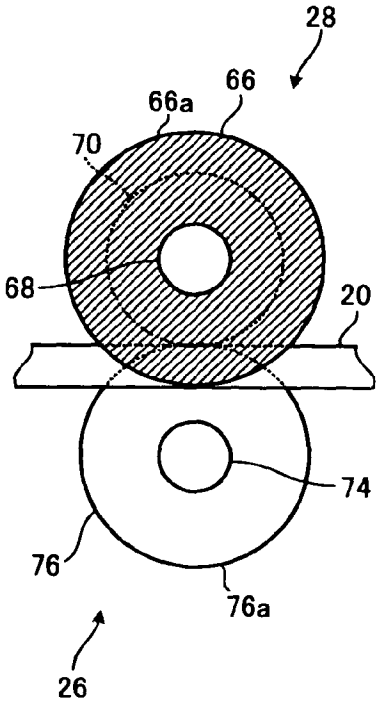

Next, a second exemplary embodiment of the present invention will be described based on FIGS. 3A and 3B.

The feed roller 28 according to the present exemplary embodiment has the first support shaft 68 rotatably supported with the image forming apparatus main body 12 and the first main body 70 supported with the first support shaft 68. Two deforming members 66 are provided between both ends of the first main body 70 and the image forming apparatus main body 12, and rotatably supported with the first support shaft 68. Further, the deforming members 66 formed in a cylindrical shape have circumferential surfaces 66*a* larger than the first main body 70.

The retard roller 26 has the second support shaft 74 rotatably supported with the image forming apparatus main body 12 and the second main body 76 supported with the second support shaft 74. The second main body 76 is provided in a position opposite to the first main body 70 of the feed roller 28. The contact portion 80 is formed between the first main body 70 of the feed roller 28 and the second main body 76 of the retard roller 26. The retard roller 26 is rotated with a rotational force from the feed roller 28.

The deforming members 66 come into contact with the sheet 20 fed with the pickup roller 24 from the sheet feeding cassette 22, and rotate along with the conveyance of the sheet 20. By this arrangement, the deforming members 66 deform the sheet 20 in a C-shape viewed from a direction other than a direction orthogonal to the sheet conveyance direction, e.g., the sheet conveyance direction, on the upstream side of the contact portion 80 between the feed roller 28 and the retard roller 26 in the sheet conveyance direction.

Note that the deforming members 66 may be provided on the second support shaft 74.

Note that in the second exemplary embodiment of the present invention, the elements corresponding to those of the first exemplary embodiment of the present invention have the same reference numerals and the explanations of the elements are omitted.

Figure 4:
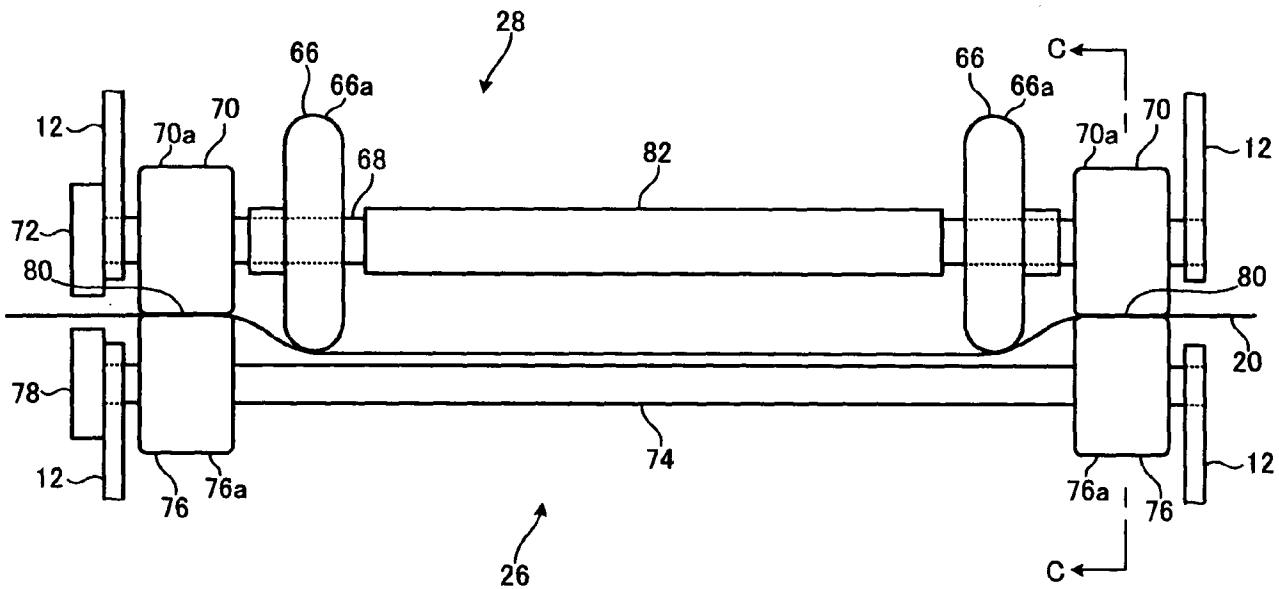
FIG. 4A is a front view showing the sheet feeding device according to a third exemplary embodiment of the present invention.
FIG. 4B is a cross-sectional view of the sheet feeding device according to the third exemplary embodiment of the present invention cut along a line C-C in FIG. 4A.
Figure 4:
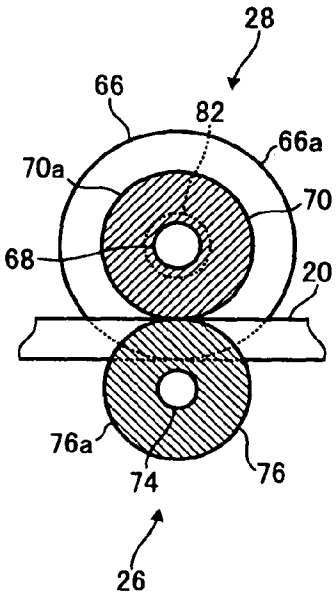
Figure 5:
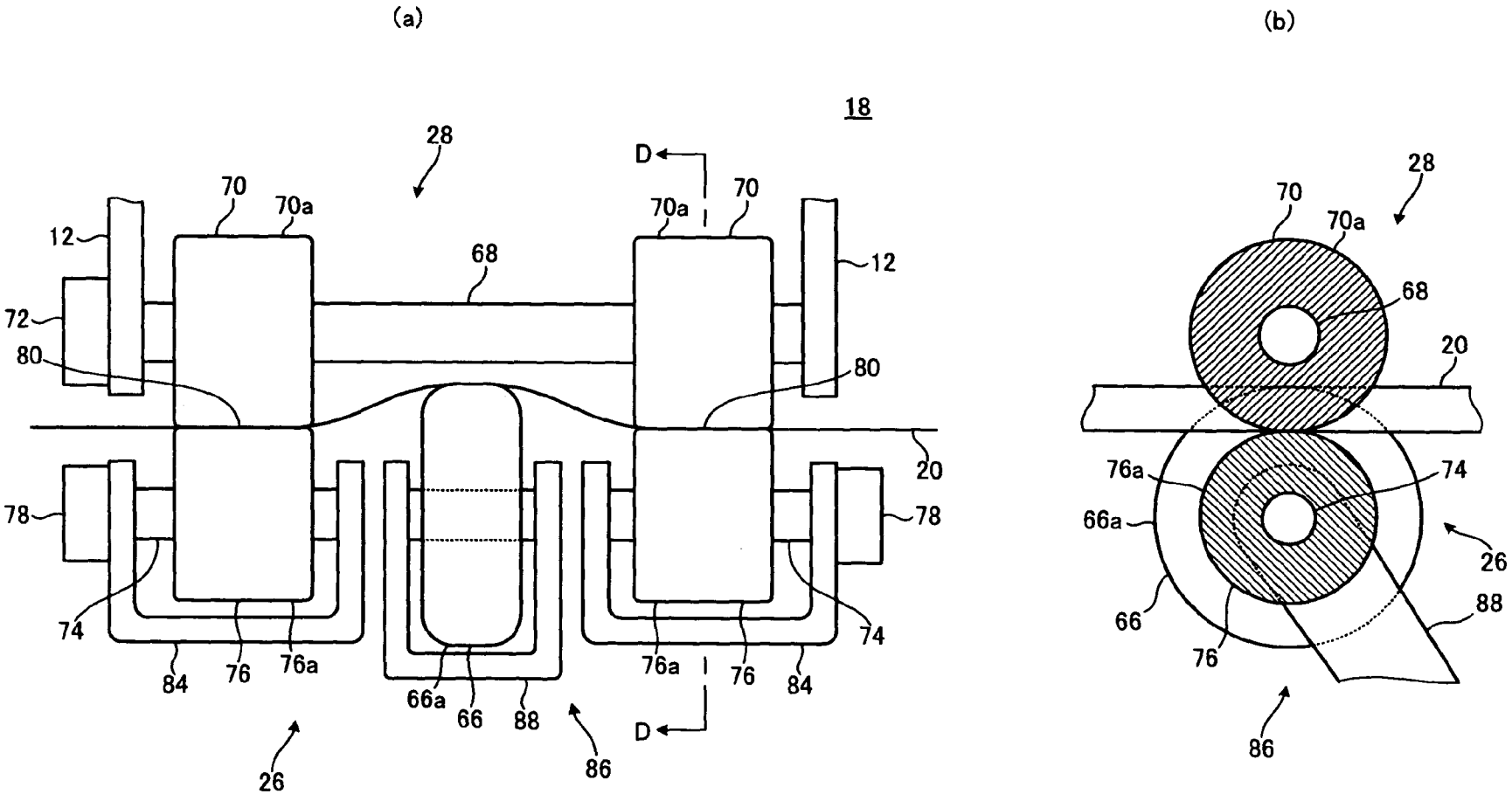
FIG. 5A is a front view showing the sheet feeding device according to a fourth exemplary embodiment of the present invention.
FIG. 5B is a cross-sectional view of the sheet feeding device according to the fourth exemplary embodiment of the present invention cut along a line D-D in FIG. 5A.

Next, a third exemplary embodiment of the present invention will be described based on FIGS. 4A and 4B.

The feed roller 28 in the present exemplary embodiment has the first support shaft 68 and two first main bodies 70 supported with the first support shaft 68. The interval between the two first main bodies 70 is longer than that between the two first main bodies 70 of the first exemplary embodiment. Two deforming members 66 are rotatably supported with the first support shaft 68, and respectively provided in positions near the first main bodies 70 from the center of the first support shaft 68. A spacer 82 formed in a cylindrical shape is provided between the two deforming members 66, thereby regulates movement of the two deforming members 66 in the axial direction.

The deforming members 66 come into contact with the sheet 20 fed with the pickup roller 24 from the sheet feeding cassette 22, and rotate along with the conveyance of the sheet 20. By this arrangement, the deforming members 66 deform the sheet 20 in a C-shape viewed from a direction other than a direction orthogonal to the sheet conveyance direction, e.g., the sheet conveyance direction, on the upstream side of the contact portion 80 between the feed roller 28 and the retard roller 26 in the sheet conveyance direction.

Note that the deforming members 66 and the spacer 82 may be provided on the second support shaft 74.

Note that in the third exemplary embodiment of the present invention, the elements corresponding to those of the first exemplary embodiment of the present invention have the same reference numerals and the explanations of the elements are omitted.

Next, a fourth exemplary embodiment of the present invention will be described based on FIGS. 5A to 11.

The retard roller 26 in the present exemplary embodiment has two second main bodies 76 and two second support shafts 74. The two support shafts 74 are respectively rotatably supported with two main body frames 84 having an approximately U-shaped cross-section. The two second main bodies 76 are respectively supported with the two second support shafts 74.

Figure 6:
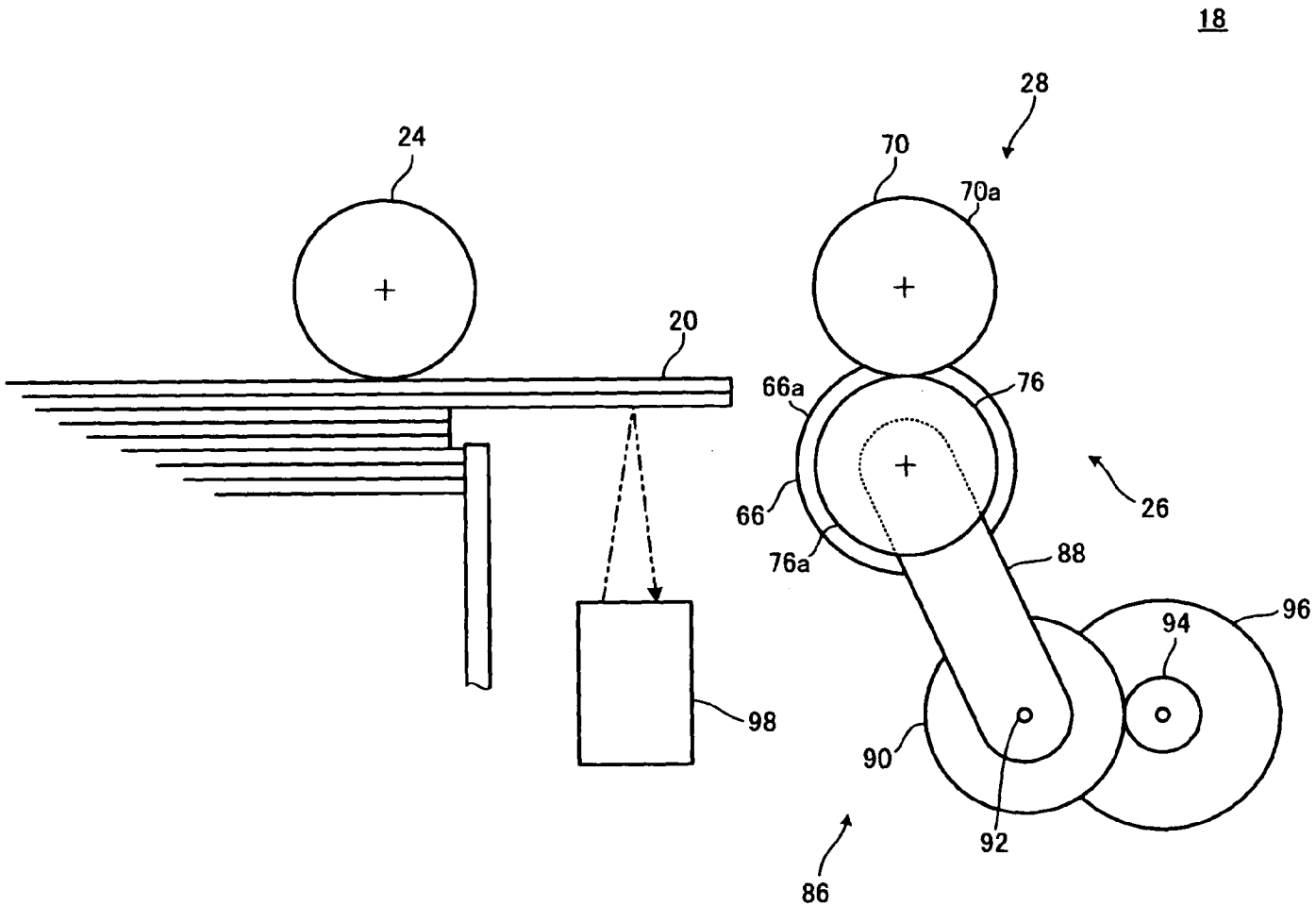
FIG. 6 is a cross-sectional view showing the sheet feeding device according to the fourth exemplary embodiment of the present invention.
Figure 7:
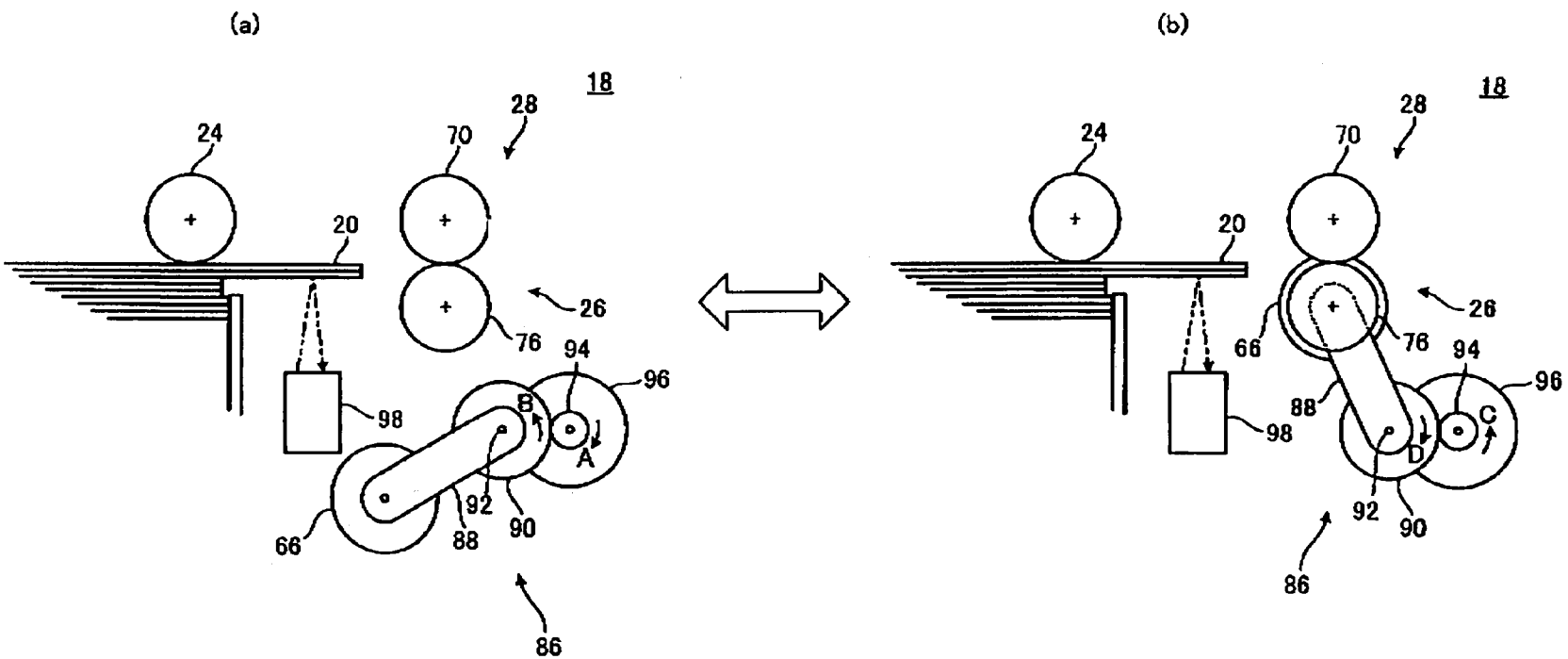
FIG. 7A is a cross-sectional view showing an operation of the sheet feeding device according to the fourth exemplary embodiment of the present invention in a state where a deforming member has been moved to a position away from a sheet.
FIG. 7B is a cross-sectional view showing the operation of the sheet feeding device according to the fourth exemplary embodiment of the present invention in a state where the deforming member has been moved to a position to contact the sheet.

As shown in FIG. 6, a deforming member moving device 86 has the deforming member 66, a lever 88, a first gear 90, a support shaft 92, a second gear 94 and a motor 96. The deforming member 66 is rotatably provided on one end of the lever 88, and the first gear 90 is fixed to the other end of the lever 88. The first gear 90 is rotatably provided on the support shaft 92 provided in the image forming apparatus main body 12. The motor 96 is forward/reverse rotatable, and the second gear 94 is fixed to an output shaft of the motor 96. The second gear 94 is provided in a position to be engaged with the first gear 90.

As shown in FIG. 7A, when the second gear 94 of the motor 96 forward-rotates (rotates in an arrow A direction in FIG. 7A), the lever 88 rotates in an arrow B direction in FIG. 7A about the support shaft 92 along with the second gear 92. By this rotation, the deforming member 66 moves to a position away from the sheet 20. Further, as shown in FIG. 7B, when the second gear 94 of the motor 96 reverse-rotates (rotates in an arrow C direction in FIG. 7B), the lever 88 rotates in an arrow D direction about the support shaft 92 along with the second gear 94. By this rotation, the deforming member 66 moves to a position to contact the sheet 20.

Figure 11:
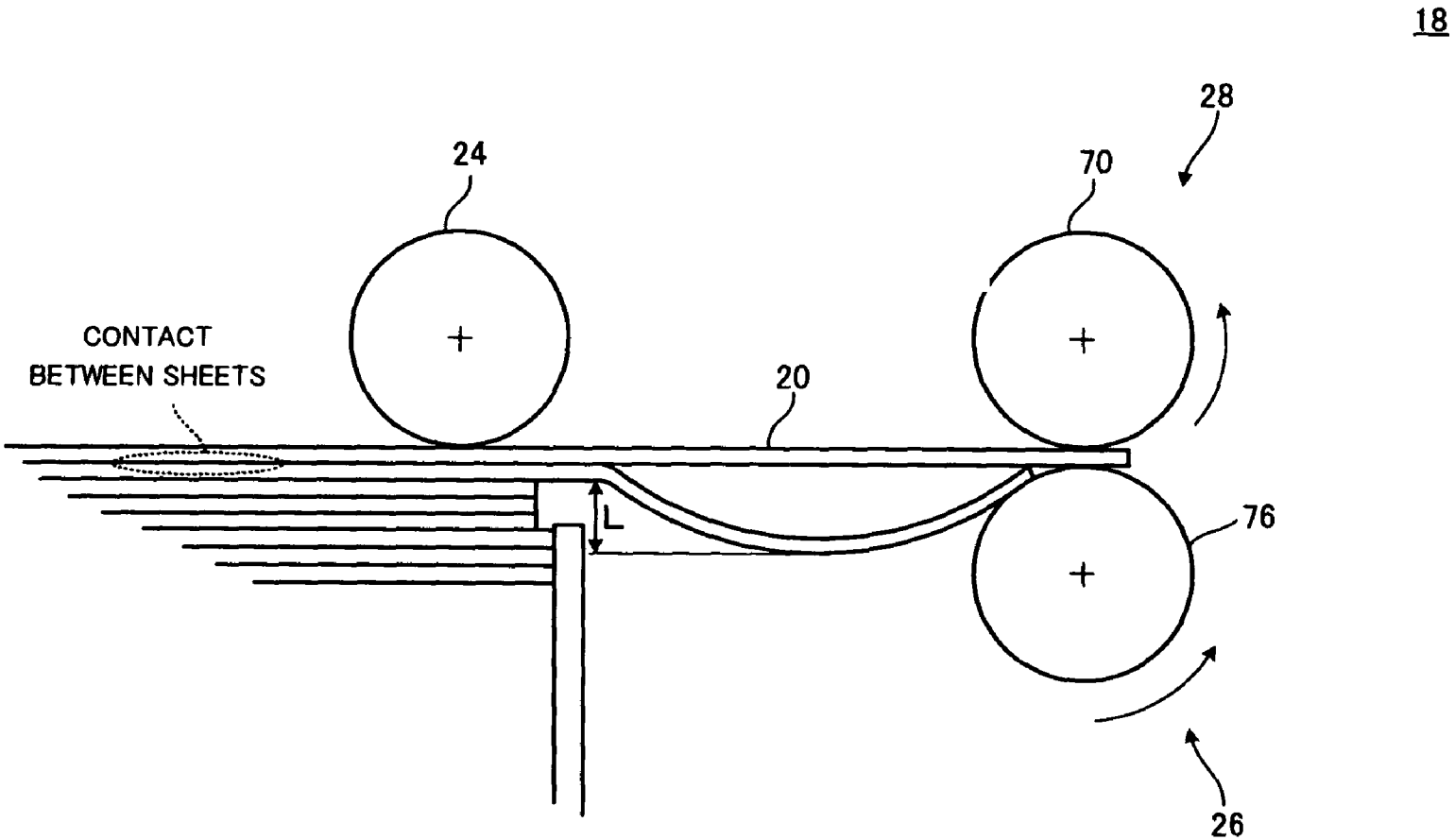
FIG. 11 is a cross-sectional view explaining buckling of a sheet.

A displacement sensor 98 as an example of a detection unit having a light emitting device and a photoreception device is provided on the upstream side of the sheet conveyance direction from the contact portion 80 between the feed roller 28 and the retard roller 26. The displacement sensor 98 emits light from the light emitting device to the sheet 20, and receives reflected light with the photoreception device, thereby detects buckling of the sheet 20 as shown in FIG. 11. The displacement sensor 98 is electrically connected to the controller 30, and outputs buckling of the sheet 20, i.e., a displacement amount (e.g., "L" in FIG. 11) of the sheet 20 to the controller 30. Note that it is known that as shown in FIG. 11, the buckling of the sheet 20 easily occurs when contact between sheets is high and the basic weight of the sheet is light.

As described later, the controller 30 performs control to move the deforming member 66 to the position to contact the sheet 20 and to the position away from the sheet 20 in correspondence with the result of detection by the displacement sensor 98.

Next, an example of the operation of the sheet feeding device 18 will be described based on FIG. 8.

Figure 8:
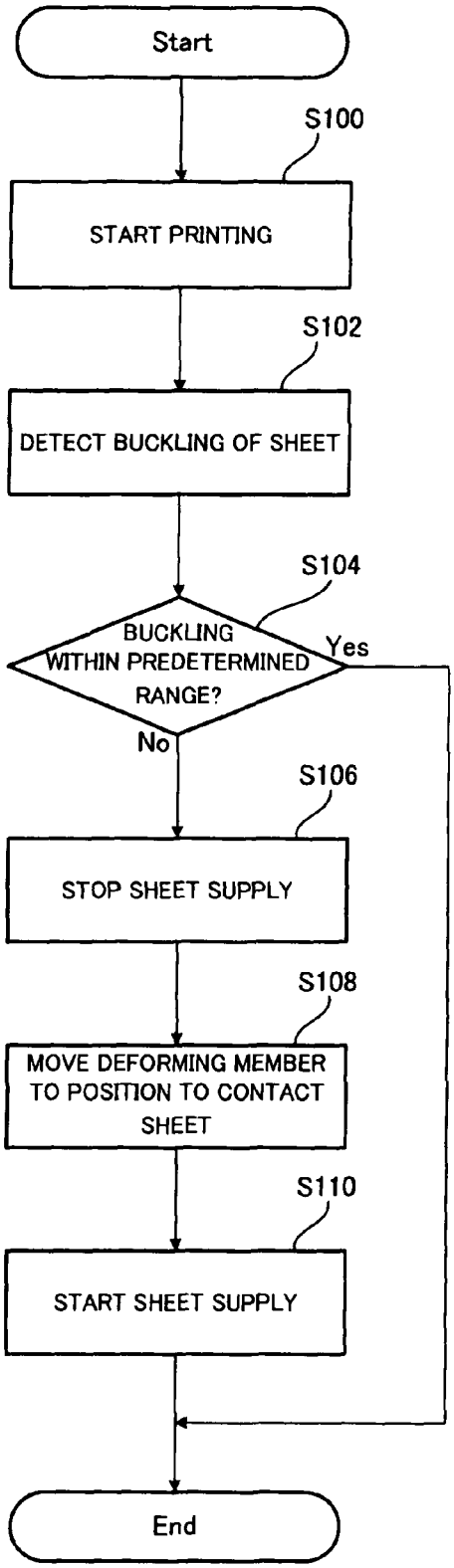
FIG. 8 is a flowchart showing an example of an operation (S10) of the sheet feeding device according to the fourth exemplary embodiment of the present invention.

FIG. 8 shows an example of the operation (S10) of the sheet feeding device 18.

As shown in FIG. 8, at step S100, the controller 30 actuates the sheet feeding device 18, the image forming unit 14 and the like, thereby starts printing.

At step S102, the displacement sensor 98 detects buckling of the sheet 20, and outputs the result of detection to the controller 30.

At step S104, the controller 30 determines based on the result of detection by the displacement sensor 98 whether or not the buckling of the sheet 20 is within a predetermined range. When it is determined that the buckling of the sheet 20 is within the predetermined range, the controller 30 continues sheet supply in the sheet feeding device 18, while when it is determined that the buckling of the sheet 20 is beyond the predetermined range, the process proceeds to processing at step S106.

At step S106, the controller 30 stops supply of the sheet 20 in the sheet feeding device 18, i.e., stops the operations of the pickup roller 24 and the feed roller 28.

At step S108, after the stoppage of the supply of the sheet 20, the controller 30 drives the motor 96 to move the deforming member 66 to the position to contact the sheet 20.

At step S110, the controller 30 starts supply of the sheet 20 by the sheet feeding device 18, i.e., restarts the operations of the pickup roller 24 and the feed roller 28. At this time, the deforming member 66 comes into contact with the sheet 20, and deforms the sheet 20 in a C-shape viewed from a direction other than a direction orthogonal to the sheet conveyance direction, e.g., the sheet conveyance direction.

Next, another example of the operation (S20) of the sheet feeding device 18 will be described based on FIG. 9.

Figure 9:
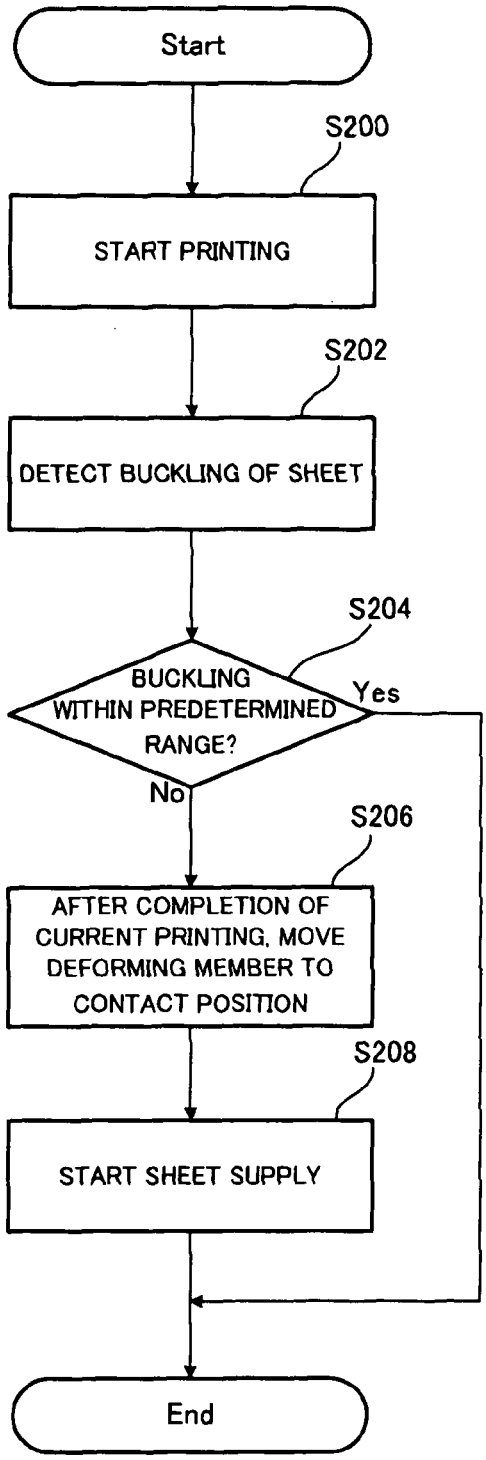
FIG. 9 is a flowchart showing another example of the operation (S20) of the sheet feeding device according to the fourth exemplary embodiment of the present invention.

As shown in FIG. 9, at step S200, the controller 30 actuates the sheet feeding device 18, the image forming unit 14 and the like, thereby starts printing.

At step S202, the displacement sensor 98 detects buckling of the sheet 20, and outputs the result of detection to the controller 30.

At step S204, the controller 30 determines based on the result of detection by the displacement sensor 98 whether or not the buckling of the sheet 20 is within a predetermined range. When it is determined that the buckling of the sheet 20 is within the predetermined range, the controller 30 continues the supply of the sheet 20 in the sheet feeding device 18, while when it is determined that the buckling of the sheet 20 is beyond the predetermined range, the process proceeds to step S206.

At step S206, after the completion of the current printing, the controller 30 drives the motor 96, to move the deforming member 66 to the position to contact the sheet 20. In this manner, the controller 30 previously moves the deforming member 66 to the position to contact the sheet 20 before the next printing.

At step S208, the controller 30 starts the supply of the sheet 20 by the sheet feeding device 18 for the next printing, i.e., starts the operations of the pickup roller 24 and the feed roller 28. At this time, the deforming member 66 comes into contact with the sheet 20, and deforms the sheet 20 in a C-shape viewed from a direction other than a direction orthogonal to the sheet conveyance direction, e.g., the sheet conveyance direction.

Next, another example of the operation (S30) of the sheet feeding device 18 will be described based on FIG. 10.

Figure 10:
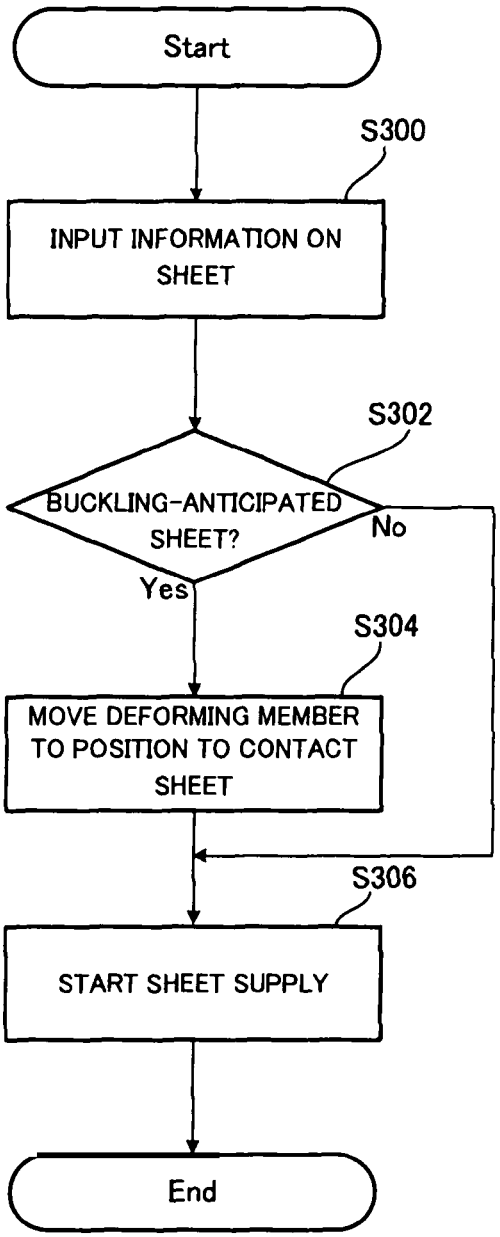
FIG. 10 is a flowchart showing another example of the operation (S30) of the sheet feeding device according to the fourth exemplary embodiment of the present invention.

As shown in FIG. 10, at step S300, a user inputs information on the sheet 20 to be used in printing via the user interface device 31. For example, the user inputs information on the sheet 20 (e.g., sheet type (coated sheet, normal sheet or the like), basic weight, thickness and the like).

At step S302, the controller 30 determines based on the information on the sheet 20 inputted via the user interface device 31 whether or not the occurrence of buckling is anticipated regarding the sheet 20. When it is determined that the occurrence of buckling is not anticipated, the process proceeds to processing at step S306, while when it is determined that the occurrence of buckling is anticipated, the process proceeds to processing at step S304. For example, when the basic weight of the sheet is light and the contact between the sheet is high (e.g., thin coated sheet), the controller 30 determines that the occurrence of buckling is anticipated.

At step S304, the controller 30 drives the motor 96 to move the deforming member 66 to the position to contact the sheet 20.

At step S306, the controller 30 starts the supply of the sheet 20 by the sheet feeding device 18, i.e., starts the operations of the pickup roller 24 and the feed roller 28. At this time, the deforming member 66 comes into contact with the sheet 20, and deforms the sheet 20 in a C-shape viewed from a direction other than a direction orthogonal to the sheet conveyance direction, e.g., the sheet conveyance direction.

Note that in the fourth exemplary embodiment of the present invention, the elements corresponding to those of the first exemplary embodiment of the present invention have the same reference numerals and the explanations of the elements are omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium supply apparatus comprising:

a conveyance member that conveys a recording medium, the conveyance member including a main body and a deforming member, each of the main body and the deforming member being formed coaxially in a cylindrical shape;

a retard member, in contact with the conveyance member, that forms a contact portion between the deforming member of the conveyance member and the retard member and retards the recording medium by holding the recording medium at the contact portion, the retard member has a retard member axis; and wherein the deforming member contacts the recording medium before the recording medium contacts the contact portion, wherein the deforming member has a diameter larger than the main body, wherein the deforming member rotates along with sheet conveyance on the retard member axis to contact the recording medium and away from the recording medium to a position off the retard member axis.

2. A recording medium supply apparatus comprising:

a conveyance member that conveys a recording medium;

a retard member, in contact with the conveyance member, that forms a contact portion between the conveyance member and the retard member and retards the recording medium by holding the recording medium in the contact portion;

the retard member has a retard member axis; and a buckling prevention unit having a cylindrical deforming member that contacts the recording medium on an upstream side, in a conveyance direction of the recording medium, of the contact portion between the conveyance member and the retard member that prevents buckling of the recording medium in the conveyance direction, the cylindrical deforming member deforming the recording medium in a direction other than a direction orthogonal to the conveyance direction of the recording medium, wherein the cylindrical deforming member has a diameter larger than at least one of the conveyance member and the retard member, wherein the cylindrical deforming member rotates along with sheet conveyance on the retard member axis to contact the recording medium and away from the recording medium to a position off the retard member axis.

3. The recording medium supply apparatus according to claim 1, wherein the retard member is composed of the roll of the couple, when the buckling prevention unit contacts the recording medium, the buckling prevention unit is arranged between these rolls.

4. The recording medium supply apparatus according to claim 1, wherein the retard member, in contact with the conveyance member, that forms two contact portions between the conveyance member and the retard member, and the cylindrical deforming member contacts the recording medium at a location between the two contact portions.

5. The recording medium supply apparatus according to claim 1, further comprising:

a detection unit that detects buckling of the recording medium; and a controller that performs control to move the cylindrical deforming member to a position to contact the recording medium and to a position away from the recording medium, in correspondence with a result of detection by the detection unit.

6. The recording medium supply apparatus according to claim 2, wherein when the detection unit detects a predetermined amount of buckling, the controller performs control to move the deforming member to the position to contact the recording medium.

7. The recording medium supply apparatus according to claim 5, wherein when the detection unit detects a predetermined amount of buckling, the controller previously performs control to move the deforming member to the position to contact the recording medium before next printing.

8. The recording medium supply apparatus according to claim 5, wherein when the detection unit detects a predetermined amount of buckling, the controller performs control to stop supply of the recording medium, and move the deforming member to the position to contact the recording medium after stoppage of the supply of the recording medium.

9. An image forming apparatus comprising:

an image forming unit; and a recording medium supply device having:

a conveyance member that conveys a recording medium to the image forming unit;

a retard member, in contact with the conveyance member, that forms a contact portion between the conveyance member and the retard member and retards the recording medium by holding the recording medium in the contact portion;

the retard member has a retard member axis; and a buckling prevention unit having a cylindrical deforming member that contacts the recording medium on an upstream side, in a conveyance direction of the recording medium, of the contact portion between the conveyance member and the retard member that prevents buckling of the recording medium in the conveyance direction, the cylindrical deforming member deforming the recording medium in a direction other than a direction orthogonal to the conveyance direction of the recording medium, wherein the cylindrical deforming member has a diameter larger than at least one of the conveyance member and the retard member, wherein the cylindrical deforming member rotates along with sheet conveyance on the retard member axis to contact the recording medium and away from the recording medium to a position off the retard member axis.

10. The image forming apparatus according to claim 9, further comprising:

an input unit that inputs information on the recording medium; and a controller that performs control to move the cylindrical deforming member to a position to contact the recording medium and to a position away from the recording medium in correspondence with the information on the recording medium inputted via the input unit.

11. The image forming apparatus according to claim 9, wherein the retard member, in contact with the conveyance member, that forms two contact portions between the conveyance member and the retard member, and the cylindrical deforming member contacts the recording medium at a location between the two contact portions.

* * * * *